US006966160B2

(12) United States Patent
Brown et al.

(10) Patent No.: US 6,966,160 B2
(45) Date of Patent: Nov. 22, 2005

(54) PLANT-ON TRIM ELEMENTS AND METHODS

(76) Inventors: Al Brown, 9035 Westwind, Las Vegas, NV (US) 89139; Douglas A. Rein, 4201 Decatur Blvd. #2177, Las Vegas, NV (US) 89103

( * ) Notice: Subject to any disclaimer, the term of this patent is extended or adjusted under 35 U.S.C. 154(b) by 0 days.

(21) Appl. No.: 10/694,829

(22) Filed: Oct. 29, 2003

(65) Prior Publication Data

US 2005/0091942 A1 May 5, 2005

(51) Int. Cl.[7] ..... B44F 7/00
(52) U.S. Cl. ..... 52/312; 52/311.3; 52/309.14; 52/717.04; 52/741.41
(58) Field of Search ..... 52/312, 311.3, 52/309.14, 344, 352, 361, 364, 288.1, 716.1, 52/717.04, 745.2, 741.41

(56) References Cited

U.S. PATENT DOCUMENTS

| | | | | |
|---|---|---|---|---|
| 4,288,962 | A | 9/1981 | Kavanaugh | |
| 4,510,726 | A | 4/1985 | MacDonald, Jr. | |
| 5,029,424 | A | 7/1991 | Hingos | |
| 5,218,798 | A | 6/1993 | Bentivegna et al. | |
| 5,481,843 | A | 1/1996 | Kreikemeier | |
| 5,540,023 | A | 7/1996 | Jaenson | |
| 5,625,986 | A * | 5/1997 | Mansfield et al. | 52/255 |
| 5,637,384 | A | 6/1997 | Boot | |
| 5,685,116 | A | 11/1997 | Bradshaw et al. | |
| 5,697,195 | A | 12/1997 | Maylon | |
| 6,176,059 | B1 | 1/2001 | Cantarano et al. | |
| 6,233,892 | B1 | 5/2001 | Tylman | |
| 6,293,068 | B1 | 9/2001 | Harrington, Jr. | |
| 6,481,170 | B1 * | 11/2002 | Savenok et al. | 52/288.1 |
| 6,591,566 | B1 | 7/2003 | Rodlin | |
| 6,609,341 | B2 | 8/2003 | Maylon et al. | |
| 6,802,163 | B2 * | 10/2004 | Hackman et al. | 52/211 |
| 2003/0079429 | A1 | 5/2003 | Rodlin | |

* cited by examiner

*Primary Examiner*—Naoko Slack
(74) *Attorney, Agent, or Firm*—Richard C. Litman

(57) ABSTRACT

The plant-on trim elements are trim elements attached to door and window openings or elsewhere on a building made of stucco or similar material. The plant-ons have a foraminous lath shell and a mating core, with the core having one or more (preferably a series of) reliefs formed therein, e.g. along the outer corners of the core. The reliefs allow stucco or other suitable material to flow completely through the foraminous lath and encapsulate the lath at the relief areas, thereby providing a much stronger bond between the coating material and the underlying lath shell. The foraminous material may be expanded metal or metal or plastic screen, while the core may be formed of foam plastic, wood, or other suitable material.

11 Claims, 7 Drawing Sheets

PLANT-ON TRIM ELEMENTS AND METHODS

BACKGROUND OF THE INVENTION

1. Field of the Invention

The present invention relates generally to trim elements for building structures, and more specifically to stucco (or other suitable material) coated plant-ons used as trim elements on such structures. The present invention comprises a series of embodiments of such plant-on elements, with each including at least one relief formed in the core material within the lath shell. The relief allows the stucco material to flow behind and encapsulate the porous lath at the relief areas, thereby providing better adhesion of the stucco to the lath than in previous plant-ons. Methods of forming the lath and assembling and installing the plant-on are also disclosed.

2. Description of the Related Art

Trim elements have been used for ages, for the architectural enhancement of building structures. Such trim components are used around door, window, and vent openings, soffits and cornices, lateral bands between floors of multiple story buildings, and other areas, in order to break up the otherwise plain and unadorned appearance of such structures.

Stucco, or a similar material, is commonly used as a finish coating upon many structures. It is especially popular in the southwestern United States, where it may be used as a simulation for adobe structures, but stucco and similar materials are used in many other areas as well. "Plant-on" trim elements comprising laths applied to the exterior structure and then coated with stucco, are often used with such structures to enhance their appearance.

Various different techniques have been developed in the past for forming and installing such plant-on elements. Almost all of these techniques result in plant-ons which are not optimized for their intended use. Many, if not most, conventional plant-ons comprise a solid core material of wood or foam, which is encased in a closely fitting foraminous lath material. A major problem which occurs with conventional plant-ons is the lack of adhesion of the stucco or other coating material to the underlying lath, particularly at corners where chipping of the finish coating is most likely to occur. A major cause of such lack of adhesion is the lack of space behind the lath material for the stucco or other material to flow therein due to the core material filling the volume within the lath, thus limiting the amount of grip between the stucco and the lath.

As a result, some contractors have eliminated the core material from the lath, with the lath interior comprising an empty space. This allows the stucco or other material to flow around and through the passages in the porous lath material, to encapsulate the lath and provide a good mechanical grip between the stucco and the lath. However, the lack of any core material within the lath shell results in a relatively weak structure that is easily damaged by relatively slight impacts. While the lath material is likely relatively flexible, the stucco or similar material applied thereto is relatively brittle when dry. The relatively thin stucco coating over a thin lath screen does not provide any significant structural strength. Relatively small impacts can cause the lath to flex, thereby cracking and chipping the overlying stucco material adhered thereto.

The maintenance of the exterior coating is critical to the appearance of such trim components. While virtually all building codes require ferrous metal components, such as lath and similar devices, to be formed of galvanized material in order to preclude rusting, the galvanized coating cannot provide indefinite protection for the underlying metal. The lath material is often scratched or abraded during handling and installation, which results in the removal of the galvanized coating in at least some areas. When other protective coatings, such as stucco, paint, etc. are chipped away or crack, moisture and oxygen can attack the ferrous metal and cause it to rust. The result is unsightly rust stains seeping from the cracks or chips in the stucco material coating the lath.

The present invention provides a solution to the above described problem by providing one or more (preferably a plurality of) reliefs in the core material encased within the surrounding foraminous lath of the plant-on. In the present invention, any convex edges of the core material are removed, thereby providing an open space between the edges of the core material and the overlying lath. When the lath is coated with stucco or similar material, the fluid stucco flows through the passages in the foraminous lath sheet and into the relief space(s) of the core, to encapsulate the lath structure along the relief areas of the core. This construction provides the desired resistance to damage provided by the inclusion of a core material within the lath, while also providing complete flowthrough of the stucco or other material along the edges of the lath to provide better adhesion for the coating material to the lath. The present invention also includes methods of forming, assembling, and installing a plant-on element having cores with such reliefs formed therein.

A discussion of the related art of which the present inventors are aware, and its differences and distinctions from the present invention, is provided below.

U.S. Pat. No. 4,288,962 issued on Sep. 15, 1981 to Harvey H. Kavanaugh, titled "Method Of Forming Structural Walls And Roofs," describes a series of embodiments wherein expanded polystyrene foam is applied between wall panels and/or sprayed upon roof sheathing. In one embodiment, expansion strips are installed upon the roof before a coating material is applied. The outer portion of the expansion strips remains exposed, unlike the lath components of the present invention. Moreover, the Kavanaugh assembly teaches away from the present invention, in that the Kavanaugh expansion strips are intended to allow relative movement between components to reduce cracking of the surrounding material. No such movement is provided in the plant-ons of the present invention.

U.S. Pat. No. 4,510,726 issued on Apr. 16, 1985 to Milton H. MacDonald, Jr., titled "Insulated Building Structure And Method For Assembling Same," describes a double stud wall construction having foam block insulation installed within the double wall. The exterior studs protrude outwardly beyond the insulation material, but the lateral space between the studs is covered or filled with sheathing or foam to provide a smooth, unbroken wall. No plant-ons or other protuberances are disclosed in the finished wall construction of MacDonald, Jr.

U.S. Pat. No. 5,029,424 issued on Jul. 9, 1991 to Donald D. Hingos, titled "Decorative Quoin," describes several embodiments of a prefabricated decorative quoin structure which may be applied to a completed building structure before the finish coat of stucco or other material is applied. Hingos provides a mesh lath, and applies cement, stucco, or similar material to the porous mesh so that the material flows through the porosity of the mesh to completely encapsulate the mesh. In some embodiments (FIGS. 3 and 4), Hingos places some lightweight foam material atop the initial cement or stucco material, overlying the base screen material. He then completes the buildup by applying another layer of cement or the like over the foam, with an optional screen being placed within the outer layer of cement. The completed assembly is then removed from its mold and applied to the building structure. While Hingos discloses the use of an (optional) screen overlying a foam core, he does not disclose any form of reliefs formed along the edges of the foam (or other) core material within his quoins. As Hingos completely encapsulates the imbedded mesh panels within his quoins, the structural strength of his quoins appears to be due primarily to the thickness of the cement or other material applied, as Hingos states that his quoins must be constructed using molds to hold the uncured material in place until it dries. In contrast, the present plant-ons comprise a relatively thin coating or very few coatings of stucco or the like over an underlying lath, with the core edge reliefs providing the additional thickness of material only at the edges. This provides the additional strength where required, while also providing a relatively lightweight structure.

U.S. Pat. No. 5,218,798 issued on Jun. 15, 1993 to Peter I. Bentivegna et al., titled "Exterior Insulation Facing System," describes a wall structure formed of corrugated panels, with insulating foam sheathing applied to the exterior and a stucco or similar coating applied over the sheathing. No decorative exterior attachments (e.g. quoins, plant-ons, etc.) are disclosed by Bentivegna et al.

U.S. Pat. No. 5,481,843 issued on Jan. 9, 1996 to John E. Kreikemeier, titled "Lath For Wall Or Ceiling Construction," describes a series of embodiments of plastic lath material. Each of the embodiments includes some means of spacing the planar lath sheet material away from the underlying structure, in order that the plaster or other finish material will flow around the lath for better adhesion. However, Kreikemeier does not disclose any form of plant-on trim attachments or any core of such attachments having reliefs therein, as provided by the present invention.

U.S. Pat. No. 5,540,023 issued on Jul. 30, 1996 to Howard W. Jaenson, titled "Lathing," describes a wire screen lath having building paper interwoven therewith. The passages in the paper through which the lath wires pass, enable the plaster or similar material to flow therethrough to encapsulate the lath and at least some of the construction paper. However, Jaenson does not disclose lath material formed to provide a three dimensional shape and having a core material with reliefs, as provided by the present invention.

U.S. Pat. No. 5,625,986 issued on May 6, 1997 to Mike Mansfield et al., titled "Skeletal Reinforcing Manufacture," describes various embodiments of plant-ons having various constructions. All have the common theme of externally extending ridges along each of their outer corners, however. These ridges facilitate finish plastering by allowing a smooth faced trowel to be applied to the plaster, stucco, or other material, with the trowel blade riding along the raised guide ridges. The problem with the exposure of the underlying metal lath material, i.e. eventual rusting, has been noted further above. The present invention avoids this potential problem by completely covering the underlying lath material with stucco or similar material, and insuring that the stucco is firmly adhered to the underlying lath by means of the reliefs provided in at least some points or edges along the underlying core material. Such reliefs are not disclosed by Mansfield et al. in any of the embodiments of their building component having core material therein.

U.S. Pat. No. 5,637,384 issued on Jun. 10, 1997 to Phillip H. Boot, titled "Plasterboard Support And Cavity Spacer," describes a means of attaching wallboard panels or the like to a masonry wall. Boot provides a series of metal tracks or channels which are attached to the wall, and which provide a firm base for securing the overlying wallboard panels to the wall. The metal tracks are filled with foam plastic material, or in other embodiments the tracks are secured directly into grooves formed in the insulating foam panels attached to the masonry wall. The tracks described in the Boot disclosure are completely concealed within the wall structure, with no externally disposed decorative plant-ons being disclosed by Boot.

U.S. Pat. No. 5,685,116 issued on Nov. 11, 1997 to James H. Bradshaw et al., titled "Preshaped Form," describes the use of expanded metal material for the lath, with the lath bent to form the desired cross section and a construction paper backing applied to the interior of the lath. The lath is hollow, i.e., no core material is provided therein, unlike the present invention. The paper backing of the lath precludes significant flowthrough of the plaster, stucco, or other material applied to the lath, thereby limiting the adhesion of the finish material to the lath. The Bradshaw et al. forms, with their paper backing, lack of any relief areas for flowthrough of the finishing material, and raised guide ridges in some embodiments, more closely resemble the assembly of the Mansfield '986 U.S. patent discussed further above, than they do the present plant-on forms.

U.S. Pat. No. 5,697,195 issued on Dec. 16, 1997 to Gary J. Maylon, titled "Plaster Security Barrier System," describes a relatively flat and thin layup for application to a ceiling structure or the like. The Maylon system includes an expanded metal screen having structural paper backing, which is applied to the interior of a ceiling structure. The screen is then covered with plaster, stucco, or similar material. The Maylon system is relatively flat, with no three-dimensional buildout as provided by the present invention. Moreover, the flat and thin configuration of the Maylon assembly precludes the placement of any core material therebehind, with no space for any form of relief cutouts to provide greater adhesion for the finishing material being provided by Maylon.

U.S. Pat. No. 6,176,059 issued on Jan. 23, 2001 to Robert A. Cantarano et al., titled "Modular Concrete Building System," describes a large number of embodiments of prefabricated, interlocking wall panels. All have smooth exteriors, with no additions thereto such as the plant-ons of the present invention. No exterior plant-ons having external laths and foam cores are disclosed by Cantarano et al.

U.S. Pat. No. 6,233,892 issued on May 22, 2001 to Vincent R. Tylman, titled "Structural Panel System," describes various embodiments of panels having composite shells with foam cores. No lath screen or application of finishing stucco or plaster to the panel system is disclosed by Tylman. The only external attachment to the Tylman panels is a cap installed along the protruding peripheral ridges of the panels when used for roofing.

U.S. Pat. No. 6,293,068 issued on Sep. 25, 2001 to James T. Harrington, Jr., titled "Foam Panel And Channel Concrete Form System," describes an integral wall molding or casting system serving as the form for casting a concrete wall. The only disclosure of any form of external finish is the mention of striations in the external surface of the form, to provide better adhesion for finishing materials applied thereto. Harrington, Jr. does not disclose any form of three-dimensional build-out of his wall structure, nor the use of lath material overlying a foam core for constructing such a plant-on or build-out, as provided by the present invention.

U.S. Pat. No. 6,591,566 issued on Jul. 15, 2003 to Daniel W. Rodlin, titled "Preshaped Form," is a continuation of the '116 U.S. patent to Bradshaw et al., with Rodlin being the second inventor in the Bradshaw et al. U.S. patent. The disclosures are closely related between the two patents, with Rodlin adding some additional embodiments in the '566 U.S. patent. The discussion provided further above of the differences between the devices of the Bradshaw et al. '116 U.S. patent and the present invention is seen to apply here as well.

U.S. Pat. No. 6,609,341 issued on Aug. 26, 2003 to Gary J. Maylon et al., titled "Contoured Stucco Reveal," describes a series of channels which may be secured to a wall, with the space between the channels being filled with stucco or the like. No lath or core material is disclosed. The channels themselves define an inset space between stucco panels, rather than the opposite build-out effect provided by the present plant-ons.

Finally, U.S. patent Publication No. 2003/79,429 published on May 1, 2003 to Daniel W. Rodlin, titled "Pre-shaped Form," is a continuation of the same chain of patents and applications of the '116 Bradshaw et al. and '566 Rodlin U.S. patents discussed further above. The disclosure is substantially the same as that of the Bradshaw et al. '116 and Rodlin '566 U.S. patents. Accordingly, the discussion of the '116 U.S. patent to Bradshaw et al. further above is seen to apply here as well.

None of the above inventions and patents, taken either singly or in combination, is seen to describe the instant invention as claimed. Thus plant-on trim elements and methods solving the aforementioned problems are desired.

SUMMARY OF THE INVENTION

The present invention comprises a series of embodiments of patterns and configurations for stucco coated plant-on trim elements, and methods of forming and installing such plant-on trim components. The present plant-on elements essentially comprise a preformed lath screen or mesh formed of a foraminous sheet material with a solid core material having essentially the same shape as the lath, installed therein. The core material includes at least one, and preferably a series of, relief(s) formed along the edges and optionally along other surface areas thereof. These relief areas provide space between the overlying lath material and the core material for the flow of the finishing material (stucco, plaster, concrete, etc.) therein, with the finishing material flowing completely about the foraminous grid of the lath which extends across the relief space. This provides a much stronger attachment for the finishing material to the lath, rather than merely having the finishing material flow around the outer surfaces of the interconnected lath elements, as is conventionally done.

The lath material preferably comprises an expanded metal material, although other foraminous sheet materials, e.g. conventional woven screen, hardware cloth, etc., or even plastic material, may be used if so desired. The core material preferably comprises an expanded polystyrene foam plastic material, although other plastics, or even wood, may be used as desired. Any of a number of different lath and core cross-sectional shapes may be provided by the present invention, as desired.

The present invention further includes methods of forming, assembling, installing, and finishing such plant-ons, generally comprising forming the lath material, forming the core material to have a congruent periphery with the internal shape of the lath, forming one or more reliefs along the core material, and assembling, installing, and finishing the plant-on. The lath material may be formed by means of a roll forming machine, similar to those used in forming seamless gutter shapes. The preferred polystyrene foam is particularly easy to form for the purposes of the present invention, as a conventional hot wire type cutting device may be used to easily form the reliefs or cutouts in the material. Alternatively, wood cores may be provided, with the shapes and reliefs routed out.

Accordingly, it is a principal object of the invention to provide plant-on trim elements having superior adhesion for stucco or other suitable material applied thereto.

It is another object of the invention to provide plant-on trim elements with a foraminous lath sheet formed as desired, a core material generally conforming to the interior shape of the lath with the core having one or more relief areas thereon, and stucco or other suitable coating material applied to the exterior of the lath and flowing through and behind the lath to encapsulate the lath at the core relief areas.

It is a further object of the invention to provide various embodiments of plant-on trim elements using expanded metal and various types of screen material for the lath and foam plastic, wood, or other material for the core, and providing such plant-on elements in a variety of shapes and configurations.

Still another object of the invention is to provide a method of manufacturing and installing plant-on trim elements.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises a series of embodiments of plant-on trim elements for installation upon a structure. The present plant-ons essentially comprise a lath shell having a core material installed therein, with the core having at least one (and preferably a plurality of) relief(s) formed about its periphery. The reliefs provide space for the coating material (stucco, etc.) to flow through and behind the porous lath, and to encapsulate the lath which overlies the relief areas. This results in a stronger bonding of the coating material to the lath and greater resistance to its chipping, cracking, or separating from the lath shell. The present invention also includes methods of constructing and installing such plant-on trim components on a structure.

Figure 1:
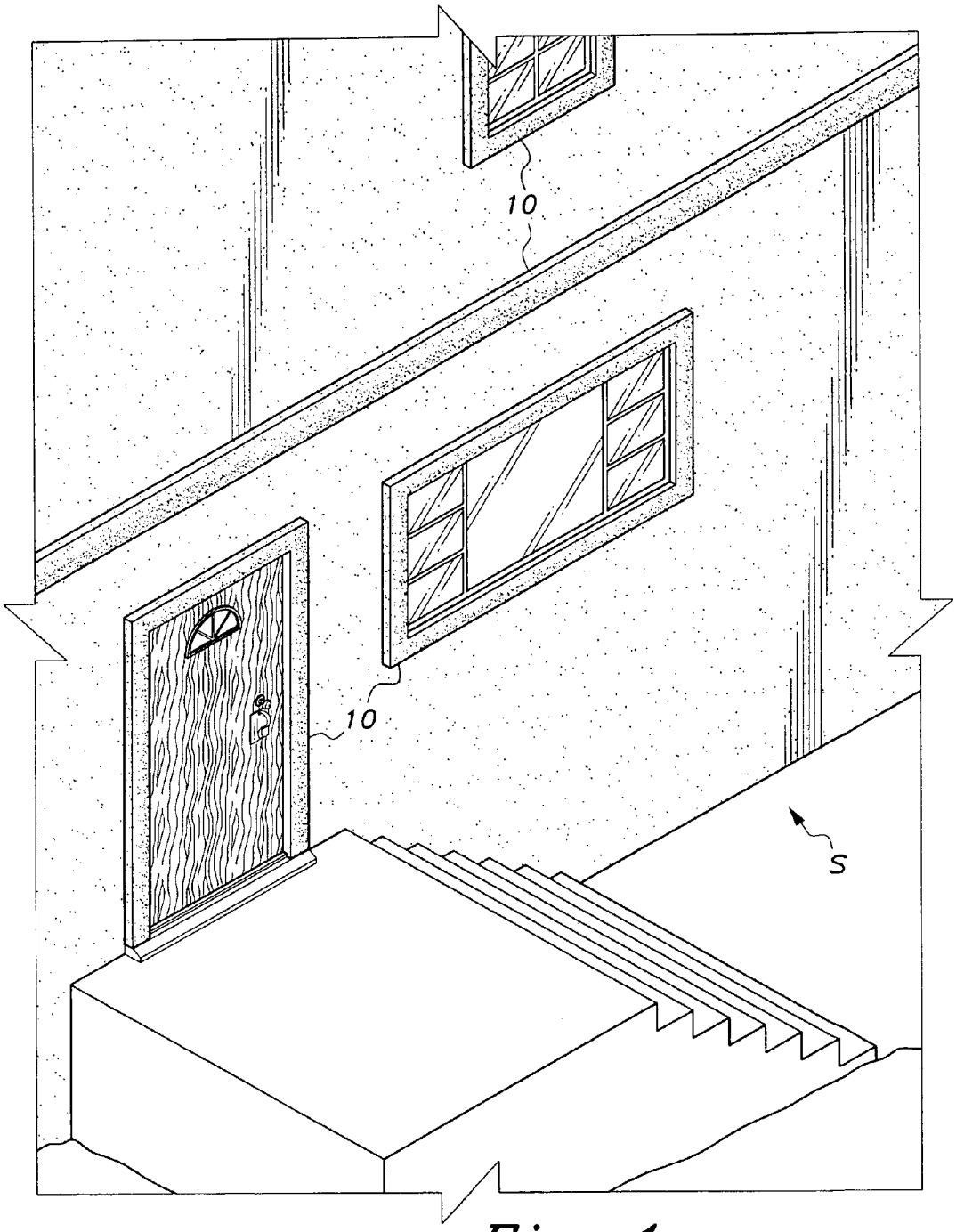
FIG. 1 is an environmental, perspective view of a building structure incorporating plant-on trim elements formed according to the present invention.

FIG. 1 of the drawings illustrates a structure S (residential home, etc.) having a series of plant-ons 10 installed thereon. Plant-ons are commonly installed surrounding door and window openings, as trim between floors of a structure, and other areas where some embellishment of the structure is desired. Plant-ons incorporating stucco or similar material for their finish are most commonly used with structures having similar finishes, but may be installed upon virtually any type of construction as desired.

Figure 2:
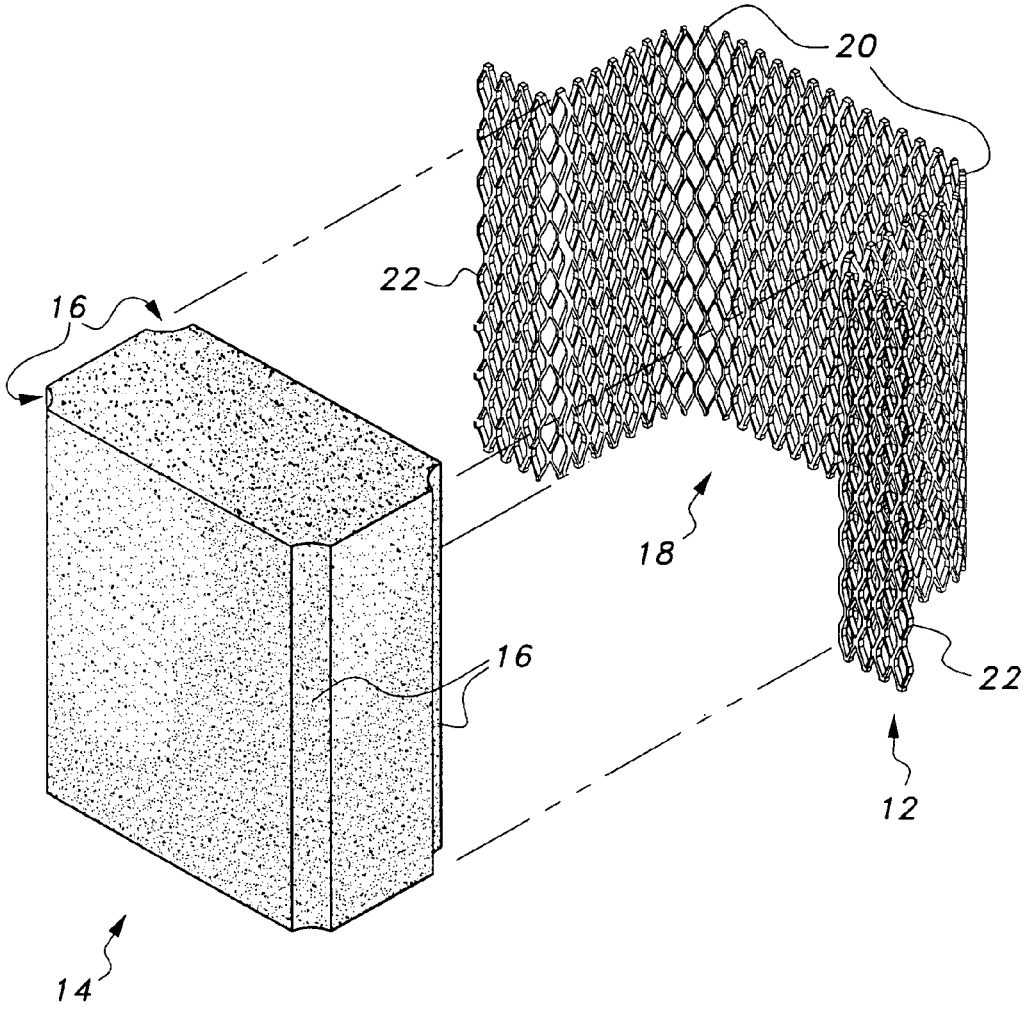
FIG. 2 is an exploded, perspective view of an exemplary expanded metal lath shell and foam plastic core with edge reliefs, showing their assembly.

FIG. 2 provides an illustration of the basic components of the present plant-on trim invention, comprising a lath shell 12 and core component 14. The lath shell 12 and core 14 are preferably formed as elongate components, generally as shown in the completed plant-ons 10 of FIG. 1. The exploded perspective view of FIG. 2 illustrates only a relatively short length of each component 12 and 14, for clarity in the drawing.

The lath shell 12 is preferably formed of a sheet of expanded metal material as shown, i.e. a sheet of metal which has been perforated with innumerable small slits, with the slits then being widened to expand the area of the sheet. However, other conventional foraminous sheet materials, e.g. woven mesh (e.g., window screen), non-woven welded or soldered mesh (hardware cloth), hexagonal pattern wire (chicken wire), perforated metal or plastic sheet materials, etc., may be used as desired. The critical characteristics of such lath material is that it must be porous or foraminous, in order for the fluid finishing material to flow therethrough before setting.

The core material 14 is formed or shaped to conform closely to the interior dimensions of the formed lath shell 12. The core material 14 is preferably an expanded polystyrene foam plastic material, but other conventional expanded foam plastics or solid plastics, wood, or other suitable material may be used as desired. Polystyrene foam plastic is advantageous in that it is relatively inexpensive, lightweight, cannot corrode, and is easily shaped and formed as desired.

A critical feature of the present plant-on elements is the provision of at least one, and preferably a series of, reliefs 16 or cutouts formed in the periphery of the core 14. These reliefs 16 provide the room or space between the overlying lath shell 12 and the core 14 for the finishing material to flow completely through the porous lath shell 12 and behind the lath shell 12 where the reliefs 16 of the core 14 are located. This results in the encapsulation of the lath shell 12 at those relief locations, and a much stronger bond between the finishing material and the lath shell 12 than could otherwise be achieved.

While the reliefs 16 of the core 14 of FIG. 2 have one-quarter circular cross-sectional shapes, the specific cross-sectional shape(s) of the reliefs is not critical. Any regular or irregular geometric cross-sectional shape may be used as desired. Also, while the reliefs 16 are illustrated as extending along the entire lengths of the corners of the core 14 in FIG. 2, it should be noted that the reliefs 16 may be formed as relatively short recesses or depressions in the surface of the core 14, if so desired. Such short recesses could be easily formed in the field by gouging out the foam plastic core 14, or possibly by heating and melting away portions of the core 14, as desired.

The expanded metal (or other foraminous material) of which the lath shell 12 is formed is generally provided as a flat sheet. The present invention includes the folding or forming of the porous metal sheet to form a three dimensional shape having an interior cavity 18, as exemplified by the lath shell 12 of FIG. 2. The lath shell 12 is formed to define a generally rectangular interior cavity 18, having rounded exterior edges 20 or corners, and opposed, outwardly extending flanges 22. However, the lath 12 and its core 14 may be formed to have any practicable regular or irregular geometric shape as desired, with additional exemplary shapes being illustrated in FIGS. 3C through 3F.

The core 16 is formed to have a shape congruent with that of the interior cavity 18 of the lath shell 12, and fits closely therein when the two components 12 and 14 are assembled together. In the example of FIG. 2, the elongate reliefs 16 formed along the edges or corners of the core 14 are located immediately within the edges 20 and adjacent the bases of the flanges 22 when the core 14 is placed within the lath shell 12. The two exterior edges 20 are the most critical areas which are prone to chipping or other damage to the finish coating, and the additional strength provided by the thicker coating surrounding the underlying lath shell 12 at those locations, as well as at the bases of the two flanges 22, greatly improves the durability of the assembly.

Figure 3A:
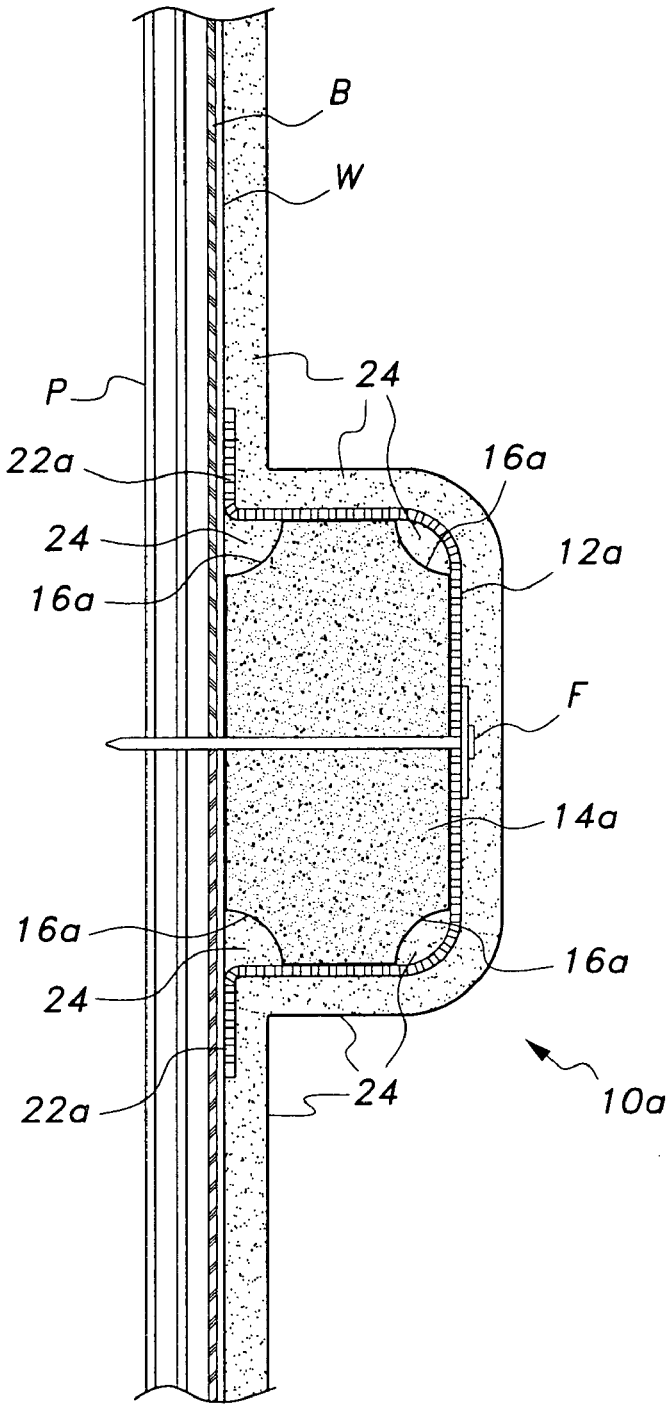
FIG. 3A is a cross-sectional view of a first embodiment plant-on element assembly installed on a structure, showing various details thereof.

FIG. 3A provides a cross-sectional view of a completed and installed plant-on element 10*a*, similar to the plant-ons 10 shown in FIG. 1. The plant-on 10*a* is installed upon a conventional building structure comprising an exterior layer of sheathing or paneling P (plywood, chipboard, etc.) covered by a sheet of building paper B, with a ply of stucco wire W attached over the building paper B. The plant-on 10*a* (or other plant-on, as desired) comprising the lath shell and core assembly with the relief(s) formed in the core, is secured to the structure by suitable fasteners F (e.g., nail and washer, etc.).

One or more coats of a suitable coating material 24, e.g. stucco, plaster, concrete or cement, etc., is applied over the structure with its external building paper B and wire W, as well as over the lath shell 12*a* of the plant-on 10*a*. Stucco is the preferred material, as it is waterproof and quite durable for exterior applications. However, any other suitable coating material may be used to coat the installed plant-ons of the present invention, as desired. The coating material 24 is sufficiently fluid upon application to flow into the pores of the foraminous lath shell 12*a*, where it is blocked from further passage by the core 14*a* within the shell 12*a*. However, the reliefs 16*a* formed at the edges of the core 14*a* allow the coating material 24 to flow behind the lath 12*a* at those locations, where the coating material 24 completely surrounds and encapsulates the lath shell 12*a*. The advantages of this configuration have been noted further above.

Figure 3B:
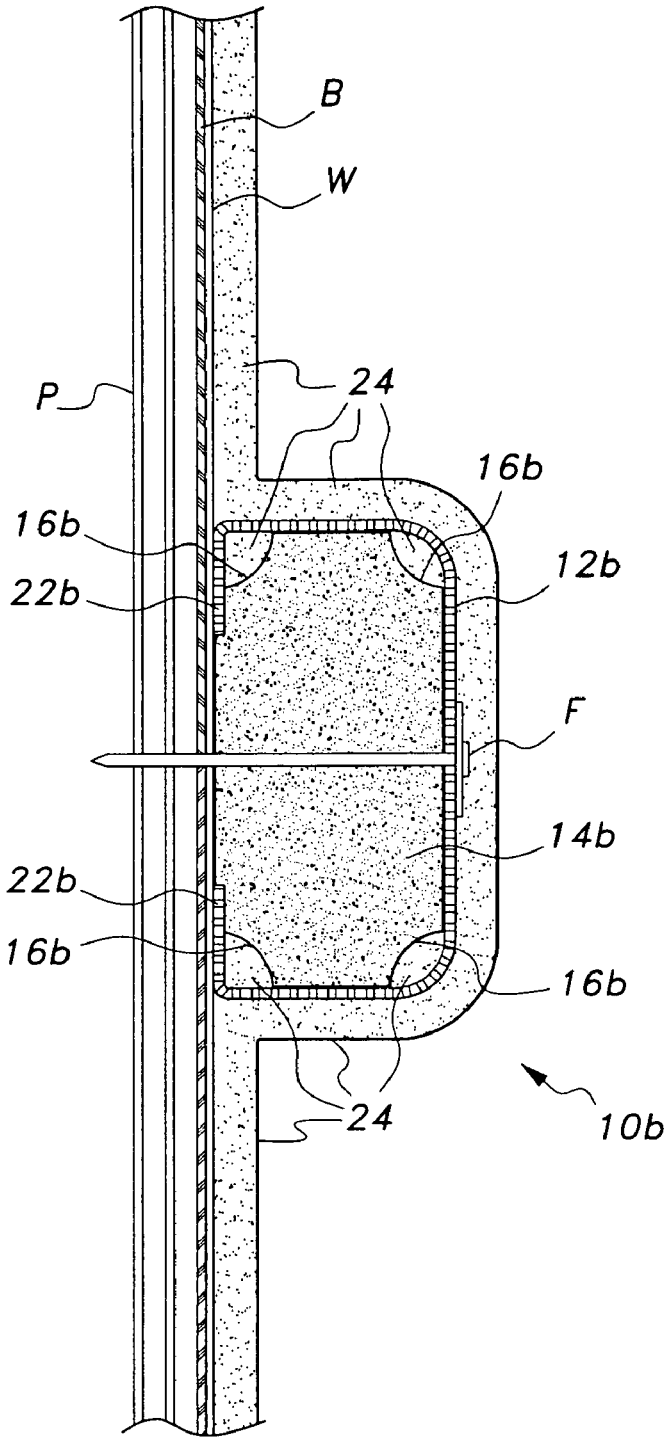
FIG. 3B is a cross-sectional view of a second embodiment assembly similar to that of FIG. 3A, showing a different flange configuration.

FIG. 3B is a cross-sectional view of another embodiment of the present invention, differing slightly from the embodiment of FIG. 3A. As in the embodiment of FIG. 3A, the plant-on 10*b* of FIG. 3B is secured to a structure comprising sheathing or paneling P, overlaid with building paper B and stucco wire W. The plant-on 10*b* of FIG. 3B is similar to the plant-on 10*a* of FIG. 3A, having a lath shell 12*b* surrounding a core 14*b* with quarter circular reliefs 16*b* formed along the edges of the rectangular core 14*b*. The assembly is coated with stucco 24 or other suitable coating material after installation, just as in the case of the plant-on 10*a* of FIG. 3A.

However, the plant-on 10*b* of FIG. 3B differs from the plant-on 10*a* of FIG. 3A, in that the plant-on 10*b* has inwardly turned flanges 22*b*, rather than the outwardly turned flanges 22*a* of the plant-on 10*a*. As the plant-ons are attached to the structure by means of fasteners F installed generally through the center of the plant-on, the flanges 22*a* or 22*b* are not used to secure the plant-ons to the underlying structure. However, they do serve to stabilize the plant-on on the underlying structure, and the inwardly turned flanges 22*b* of the plant-on 10*b* of FIG. 3B allow the plant-on 10*b* to be placed immediately adjacent some other protruding structure, e.g. a door or window frame, etc., without a gap therebetween.

Figure 3C:
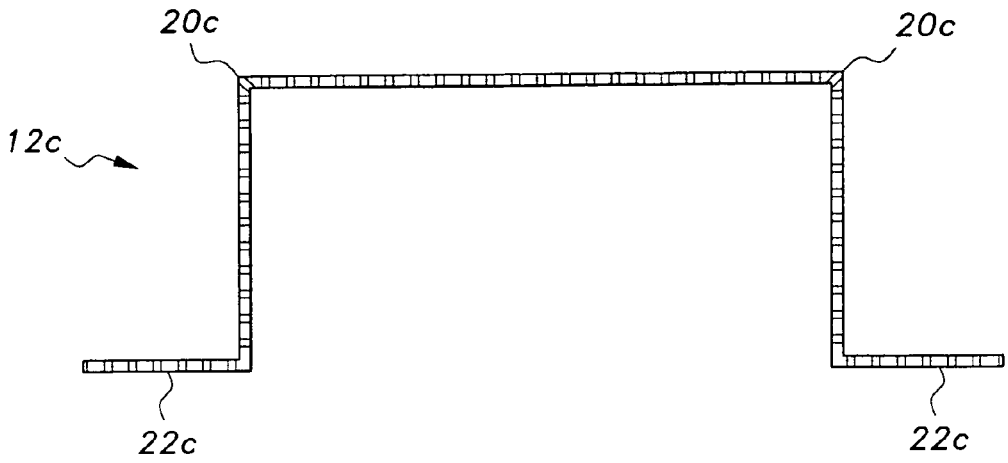
FIG. 3C is a cross-sectional view of a lath shell similar to that of FIG. 3A, but having squared outer edges.
Figure 3D:
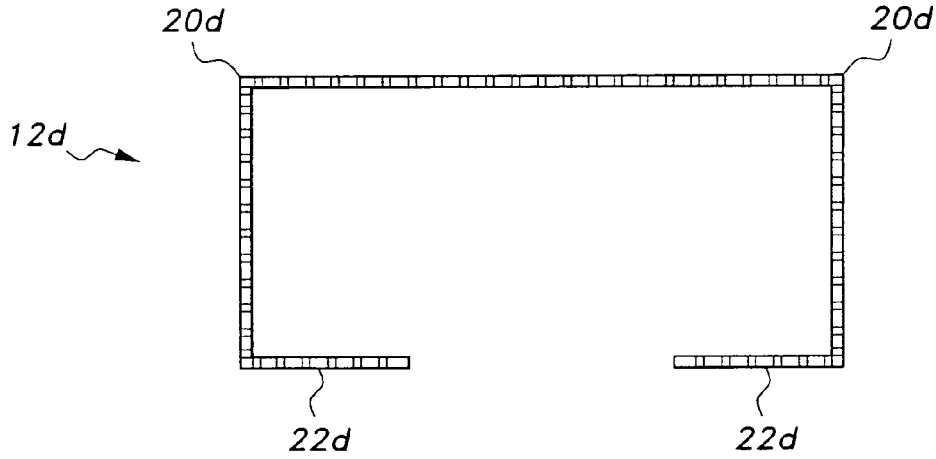
FIG. 3D is a cross-sectional view of a lath shell similar to that of FIG. 3B, but having squared outer edges.

FIGS. 3C and 3D illustrate cross sectional views of still other lath shell configurations, respectively designated as lath shells 12*c* and 12*d*. The lath shell 12*c* closely resembles the lath shells 12 of FIG. 2 and 12*a* of FIG. 3A, and includes outwardly turned flanges 22*c*. However, the exterior edges 20*c* are squared off and relatively sharp, in comparison to the rounded edges 20 of the lath shell 12 of FIG. 2. It is even more critical that the coating material provide a good bond to the underlying lath material where such relatively sharp edges are formed, as such sharp edges are even more prone to chipping of the overlying coating material. The edge reliefs provided in the core material, as illustrated in FIGS. 2 through 3B, provide a solution to this problem by allowing the coating material to flow completely behind the lath shell at the reliefs, thereby completely encapsulating the lath shell at those locations.

The lath shell 12*d* of FIG. 3D with its inwardly turned flanges 22*d* will be seen to resemble the lath 12*b* of FIG. 3B with its inwardly turned flanges 22*b*. However, the lath shell 12*d* also includes relatively sharp exterior corners 20*d*, just as in the corners 20*c* of the lath 12*c* of FIG. 3C. The generally rectangular configuration of the various lath shells 12 through 12*d* permits the installation of any of the correspondingly shaped cores, i.e. cores 14 through 14*b* with their corresponding reliefs 16 through 16*b*, therein.

Figure 3E:
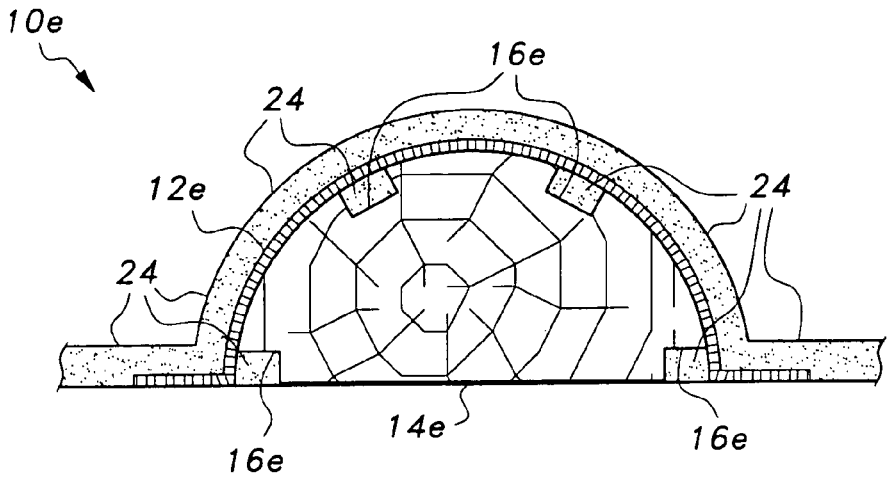
FIG. 3E is a cross-sectional view of another alternative embodiment of a plant-on assembly according to the present invention having a semicircular shape and a wood core.

FIG. 3E illustrates a cross section of yet another variation of the present plant-on, designated as plant-on 10*e*. The plant-on 10*e* has a lath shell 12*e* and core 14*e* with congruent, semicircular cross sections, thus providing a semicircular exterior shape for the assembly. The plant-on 10*e* also differs from other plant-ons discussed to this point, in that the core 14*e* is formed of wood, rather than expanded foam plastic material. The wood core 14*e* is exemplary, and it will be understood that the core of the plant-on 10*e* may be formed of any suitable material, e.g. wood, plastic, etc., and/or the cores of other plant-ons of the present invention may be formed of wood rather than plastic or some other material, as desired. The reliefs 16*e* formed in the periphery of the core material 14*e* will be noted as having a different shape than the semicircular reliefs illustrated in other drawing Figs. In FIG. 3E, the reliefs 16*e* have square or rectangular cross sections, rather than being semicircular. The various cross-sectional shapes of the relief cutouts of the present invention may be used with any of the plant-on shapes or materials, as desired.

Figure 3F:
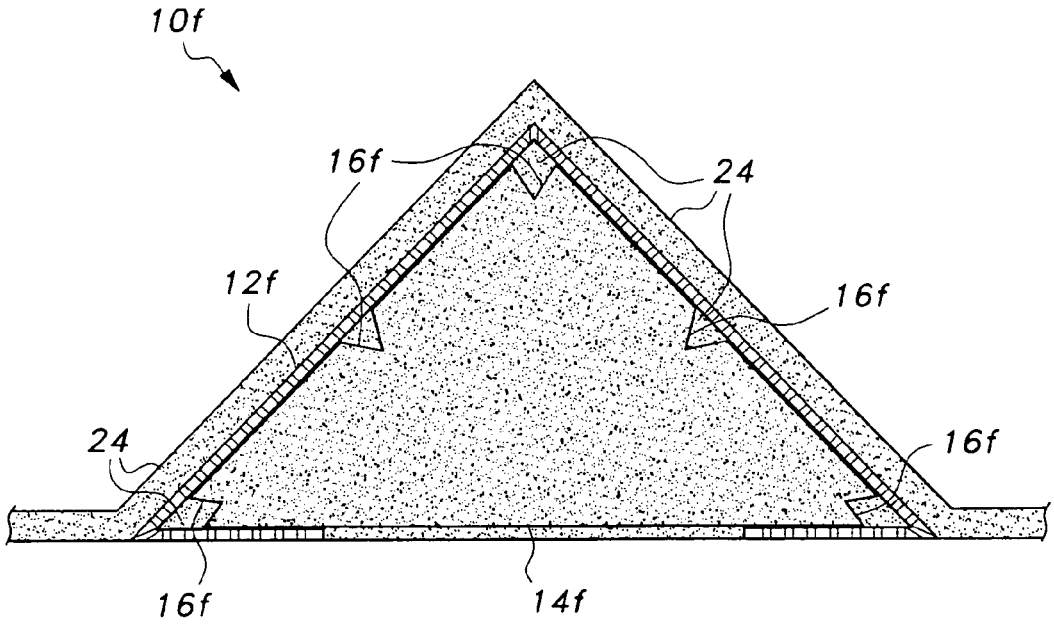
FIG. 3F is a cross-sectional view of yet another alternative embodiment of a plant-on assembly according to the present invention having a triangular shape.

FIG. 3F shows a cross section of still another embodiment of the present invention, comprising a plant-on 10*f* having a triangular cross section. As in the other embodiments, the plant-on 10*f* has a lath shell 12*f* and core 14*f* with mating shapes, allowing the core to fit closely within the lath shell. The core 14*f* includes a series of reliefs 16*f* formed along the periphery thereof, as in the other embodiments. However, the core reliefs 16*f* of the plant-on 10*f* of FIG. 3F have triangular sections, rather than the semicircular or square sections of other reliefs shown in other embodiments. As in the case of the other embodiments discussed further above, the reliefs 16*f* may be formed to have any practicable shape desired, and are not limited to the triangular shape illustrated in FIG. 3F. The shapes shown throughout the drawings are exemplary, and merely illustrate a few of the myriad possible shapes available.

In much the same manner, the various rectangular, semicircular, and triangular shapes illustrated for the lath shells and cores of the present invention illustrate but a few of the innumerable possible shapes conceivable. Any of a virtually limitless number of different regular or irregular geometric cross-sectional shapes may be used in the formation of the plant-on elements of the present invention, as desired. The critical point of the present invention is the provision of reliefs or cutouts in the core material of the plant-on, to allow the coating material 24 to flow through and behind the porous lath shell at the locations of the reliefs, thereby encapsulating the lath shell at the relief positions, regardless of shape.

Figure 4:
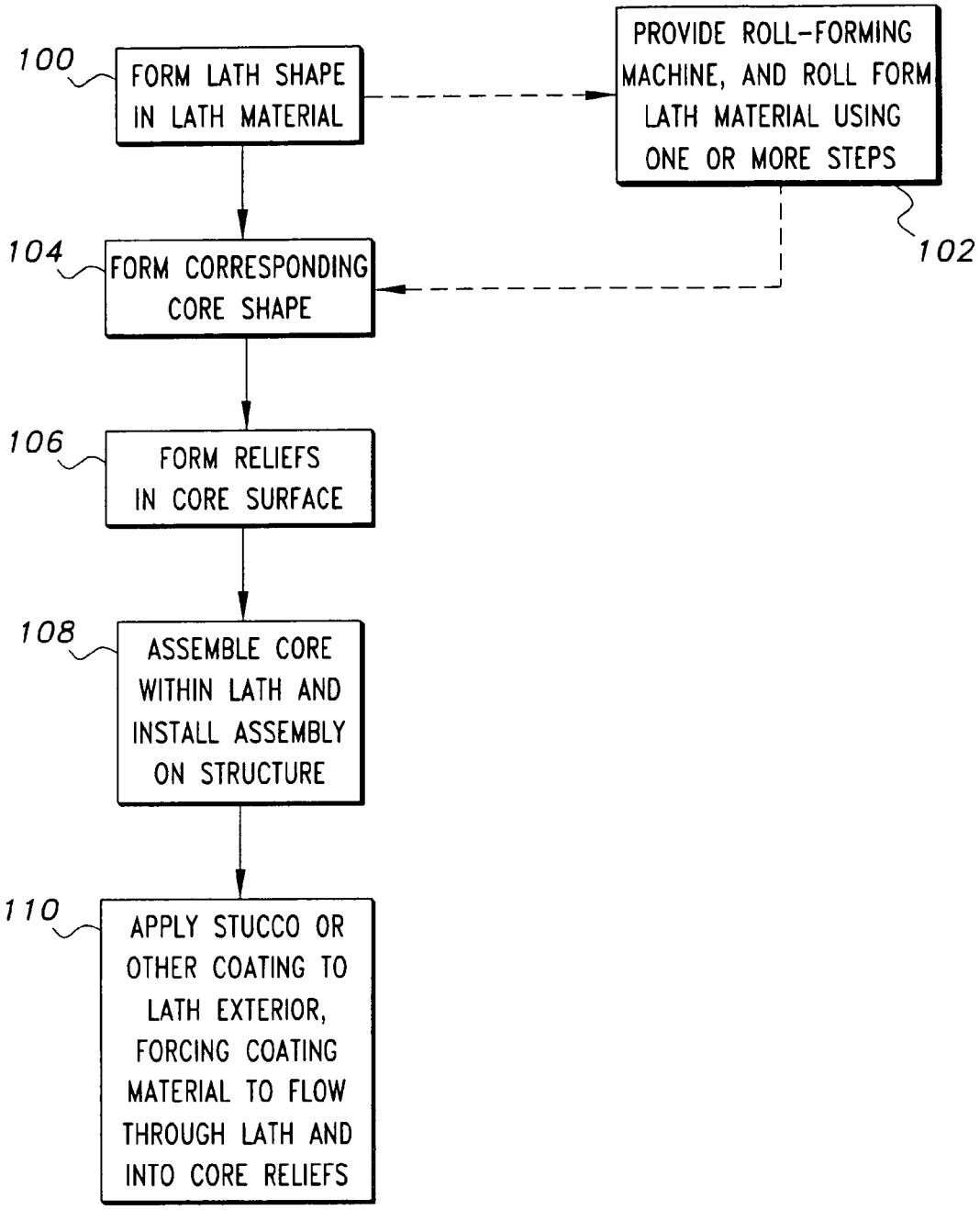
FIG. 4 is a flow chart disclosing the general steps in the method of manufacture and installation of the present plant-ons.

FIG. 4 is a flow chart showing the general steps in the method of carrying out the present invention. Initially, the lath shell is formed, as indicated in the first step 100 of FIG. 4. The lath material is generally supplied in precut widths, or may be sheared or otherwise cut to the desired width after receipt, for the specific plant-on to be formed. The lath material is then formed to the desired three-dimensional shape for the plant-on desired. This may be accomplished in any of a number of different ways, as is known in the art of sheet metal forming and working.

However, one of the more efficient means of carrying out the bending operation is to use a roll forming machine, much like those conventionally used for forming seamless gutters from relatively lightweight aluminum sheet. However, the roll forming operation of the lath material used in the present invention may require more than a single roll forming step or operation, due to the relatively rigid nature of the expanded metal material which is preferred. Accordingly, a roll forming machine used for forming the lath shells of the present invention may be required to provide more than a single roll forming step or operation. Such a machine may require more than a single pass of the material through the machine, or may apply the required bending operations to the lath material in a series of sequential operations, in a single pass. The roll forming step of forming the lath material is shown generally as an optional step 102 in FIG. 4.

The core material is also formed at this time, in accordance with the third step 104 of FIG. 4. The technique used to form the core will depend upon the core material used. The preferred material is an expanded polystyrene foam plastic, as noted further above. Foam plastics generally lend themselves well to forming by a hot wire cutting method, where a thin, electrically resistant wire is stretched taut between two attachments and heated by electrical energy passing therethrough. The hot wire melts the foam plastic material in a thin slot of substantially the same diameter as the wire, as the wire passes through the material. Templates or guides are provided at each end of the material being cut, in order to provide an accurate cut. It will be seen that the templates or guides may be of any practicable shape desired, and will define the cross-sectional shape of the core material where the core material is provided in some other shape or size than desired for the finished core.

The cutouts or reliefs may then be formed in the plastic material, as indicated by the fourth step 106 of FIG. 4. Alternatively, the reliefs may be formed simultaneously with the formation of the core shape, depending upon the configuration of the templates or guides used. As in the formation of the core material itself, the reliefs may be formed to have any practicable shape desired, depending upon the shape of the reliefs formed in the templates or guides used. Alternatively, other means of forming the reliefs may be used, e.g. gouging, melting, or otherwise removing portions of material from the plastic core, etc., as desired.

Where wood or another core material is used which is not amenable to hot wire cutting, some other means of forming the desired shape must be used. With wood, the core material may be passed through a router or planer to achieve the desired shape of the core and its reliefs. This will likely require more than a single pass, and/or changing cutting bits; such techniques are well known in the production of wood forms and the like. Where smaller or shorter reliefs are desired, relief depressions may be formed in the wood by drilling, cutting with a rotary file, etc.

Once the lath shell and mating core have been formed, the core is installed within the shell, as indicated in the fifth step 108 of FIG. 4. Where the plant-on is provided as a pre-manufactured assembly of lath shell and core, the assembly may be transported to the field for installation. Otherwise, the plant-on may be formed at or near the jobsite, and installed soon after manufacture. The assembled plant-on comprising the lath shell and its core is then secured to the building structure as desired using suitable fasteners, generally as shown in FIGS. 3A and 3B and discussed further above.

Once the plant-on assembly has been secured to the structure, the finish coating material may be applied, as indicated by the sixth and final step 110 of FIG. 4. Normally, stucco will be used as the finish coating for the plant-ons of the present invention and the structure to which the plant-ons are attached. However, other coating materials, e.g., plaster, concrete, cement, etc., may be applied as desired, in a single or multiple coat application.

The relatively fluid coating material will flow between the pores of the foraminous lath shell, with the pores of the lath shell providing some "tooth" or "grip" for the coating material when it dries or cures. However, the closely underlying core material within the lath shell precludes any substantial flow of the coating material through the lath shell. The reliefs formed in the surface of the core material, provide a gap or space between the inner surface of the lath shell and the core wherever such reliefs are located. Thus, the coating material can flow completely through the pores of the lath material to completely surround the lath material wherever such core reliefs are located. Preferably, such core reliefs are located at least at any edges or corners of the plant-ons, enabling the coating material to build up behind the lath at those locations. Once the coating material has cured or dried, the result is considerably stronger bonding of the coating material to the lath, and greater resistance to chipping or cracking and subsequent exposure of the lath material to the elements.

In conclusion, the present plant-ons with their core reliefs provide a significant improvement in durability for any finish coatings applied thereto, by means of the superior bonding of the finish coating materials to the underlying lath shell. The use of the preferred expanded metal material for the lath shell, results in a much more rigid structure which resists bending during handling and installation. Moreover, the use of a specialized machine for forming the lath shell insures that the lath will remain straight. In contrast, prior art plant-ons have tended to be formed in the field of relatively flexible materials, and the effort required to secure the plant-on to the structure to form a straight line, often requires considerable time and effort. The present plant-ons also provide a solution to this problem, greatly reducing the time required for installation as well as providing much better adhesion for the finish coating materials to the lath shell. A smooth, even coating of the finish material over the lath is achieved without the use of protruding guides or ridges from the lath, by means of a specialized trowel which may be used with the present plant-ons. The result is a superior installation, providing both increased ease of installation and greater durability than plant-ons of the prior art.

It is to be understood that the present invention is not limited to the embodiments described above, but encompasses any and all embodiments within the scope of the following claims.

We claim:

1. A plant-on trim element, comprising:

an elongate, foraminous lath shell defining a three-dimensional shape having an interior cavity, said lath shell having opposed flanges extending therefrom;

an elongate core having a shape substantially conforming to the interior cavity of said lath shell installed within said lath shell, said core substantially being in contact with the lath shell and having at least one peripherally disposed recess defined therein separated from said lath shell; and a finish coating applied to said foraminous lath shell.

2. The plant-on trim element according to claim 1, wherein said finish coating is allowed to flow through and completely encapsulate said foraminous lath shell at each said recess of said core.

3. The plant-on trim element according to claim 2, wherein said finish coating is formed of materials selected from the group consisting of stucco, plaster, and concrete.

4. The plant-on trim element according to claim 1, wherein said lath shell is formed of sheet material selected from the group consisting of expanded metal, woven screen, hardware cloth screen, hexagonal pattern screen, and foraminous plastic sheet.

5. The plant-on trim element according to claim 1, wherein said flanges are outwardly turned.

6. The plant-on trim element according to claim 1, wherein said flanges are inwardly turned.

7. The plant-on trim element according to claim 1, wherein said lath shell shape and said core shape are selected from the group of shapes consisting of regular and irregular geometric shapes.

8. The plant-on trim element according to claim 1, wherein said core is formed from materials selected from the group consisting of foam plastic and wood.

9. The plant-on trim element according to claim 1, wherein said at least one recess has a cross sectional shape selected from the group of shapes consisting of regular and irregular geometric shapes.

10. The plant-on trim element according to claim 1, wherein said at least one recess extends the length of said elongate core.

11. A method of installing a plant-on trim element on a structure using the apparatus of claim 1, comprising the steps of:

(a) securing the lath and core assembly to the structure;

(b) applying a finish coating to the lath shell; and (c) filling the at least one recess of the core with the finish coating, thereby completely surrounding and encapsulating the portion of the lath shell over the at least one recess.

* * * * *